US006457803B1

(12) United States Patent
Ohkoda

(10) Patent No.: US 6,457,803 B1
(45) Date of Patent: Oct. 1, 2002

(54) INK JET RECORDING APPARATUS AND INK JET RECORDING METHOD

(75) Inventor: Keiji Ohkoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/583,983

(22) Filed: May 31, 2000

(30) Foreign Application Priority Data

Jun. 8, 1999 (JP) ..... 11-160805

(51) Int. Cl.[7] ..... B41J 2/165
(52) U.S. Cl. ..... 347/36; 347/35
(58) Field of Search ..... 347/35, 36

(56) References Cited

U.S. PATENT DOCUMENTS 5,291,227 A 3/1994 Suzuki
5,997,129 A 12/1999 Matsuhashi

FOREIGN PATENT DOCUMENTS

EP 0 616 893 9/1994
EP 0 707 973 4/1996
EP 0 724 965 8/1996
EP 0 842 779 5/1998
EP 0 95 603 4/2000
EP 0 992 347 4/2000
JP 8-169155 7/1996

*Primary Examiner*—Huan Tran
(74) *Attorney, Agent, or Firm*—Fitzpatrick, Cella, Harper & Scinto

(57) ABSTRACT

An ink jet recording apparatus comprises a carrier for carrying a recording medium, a head installation unit for installing a recording head to record on the recording medium by discharging ink from discharge ports while reciprocating in the width direction intersecting the carrying direction of the recording medium, a support for supporting the recording medium in a position facing the recording head, and opening portions for collecting ink discharged from the recording head at the edges of the recording medium in the width direction. With the structure thus arranged, this ink jet recording apparatus is capable of recording up to the edges of the recording medium in high quality without staining the recording medium.

13 Claims, 12 Drawing Sheets

INK JET RECORDING APPARATUS AND INK JET RECORDING METHOD

BACKGROUND OF THE INVENTION

1. Field of the Invention

The present invention relates to an ink jet recording apparatus. More particularly, the invention relates to an ink jet recording apparatus that can perform recording without marking marginal portions at the edges of a recording medium. The invention also relates to an ink jet recording method therefor.

2. Related Background Art

Conventionally, for example, the ink jet recording apparatus, which records on a paper sheet, cloth, a plastic sheet, an OHP sheet, and other recording media by discharging ink with pressure exerted by bubbles created when film boiling is generated in ink by the application of heat generated by electrothermal transducing elements, is able to perform recording in high density at high speed. The ink jet recording apparatus is, therefore, utilized and merchandised as output means of information processing systems, such as a printer, among other systems.

Also, for the ink jet recording apparatus, it has been attempted to arrange the nozzles for discharging ink in a higher density, to make the discharging ink droplets finer, and to provide a higher quality image that may be comparable with a photograph by the application of technologies that enable ink of different densities to be used or the like. As a result, it becomes possible to market an ink jet recording apparatus even in such a field as image transmission for medical use in which the operation has been carried out by use of a silver salt photograph or the like.

Generally, an ink jet recording apparatus comprises a carriage having detachably mounted thereon a recording head and ink tank that serve as recording means; carrying means for carrying a recording medium; and control means for controlling those means. Then, the recording head that discharges ink from a plurality of discharge ports is arranged, on one hand, to serially scan in the direction (hereinafter referred to as the main scanning direction) orthogonal to the carrying direction (hereinafter referred to a the sub-scanning direction) of a recording medium, and, on the other hand, the recording medium is intermittently carried in the sub-scanning direction at a given pitch at the time of a non-recording operation.

FIG. 17 is a side view which schematically shows the structure of the principal part of the conventional ink jet recording apparatus 203 of the kind described above. FIG. 18 is a perspective view which schematically shows such ink jet recording apparatus.

The conventional ink jet recording apparatus 203 comprises a recording medium supply unit 221 that supplies a recording medium 216; a recording unit 222 that performs recording by use of an ink jet recording head cartridge 224 mounted on a carriage (not shown) on the recording medium 216 which has been fed; and an exhaust sheet unit 223 which receives the exhausted recording medium 216 after recording by the recording unit 222.

Hereunder, a brief description will be made of the operation of the conventional ink jet recording apparatus 203 to record on the recording medium 216.

A number of recording mediums 216, which are stacked and set on a pressure plate 217, are pressed by the pressure plate 217 to a separation roller 218, and separated one by one by separating means, such as separation nails (not shown) and the separation roller 218. After that, the recording medium thus separated is carried to first sub-scanning rollers 208 and 209 along guide plates 219 and 220. Then, the recording medium 216 is nipped by the first sub-scanning roller 208 and 209 and carried to the recording unit 222 where recording is effected with ink discharged from a recording head 212 of the ink jet recording head cartridge 224 formed of an ink tank 213 and the recording head 212, while the position of the recording medium is regulated by means of a platen plate 215. The ink tank 213 stores ink for its supply to the recording head 212. The recording head 212 is provided with a plurality of discharge ports arranged in the sub-scanning direction (indicated by an arrow K in FIG. 18) which is the carrying direction of the recording medium 216. Also, in recording, the carriage (not shown) that mounts the ink jet recording head cartridge 224 thereon performs the recording by reciprocating in the main scanning direction (indicated by an arrow J in FIG. 18), which is orthogonal to the sub-scanning direction, along the carriage guide (not shown) arranged substantially in parallel with the rotational shaft of the sub-scanning roller. After recording, the recording medium 216 is exhausted to a recording medium receptacle 214 while being nipped by the second sub-scanning rollers 210 and 211. Roller 211 of the second sub-scanning rollers is in the form of a spur in order to avoid the adhesion of wet ink, because this roller is in contact with the recording medium immediately after recording.

The carriage is moved above predischarging ports 202 before recording, and ink is predischarged so that the recording head 212 is readied for performance of good recording. Conventionally, the predischarging ports 202 are arranged outside the carrying path of the recording medium 216 as shown in FIG. 18 so that staining of the recording medium 216 by ink that adheres to the predischarge ports 202 is avoided.

Also, on the recording medium 216, there are a recording area 201*a* where recording is effected, and non-recording areas 201*b* which become marginal portions where no recording is effected as shown in FIG. 18. If recording is effected on the non-recording areas 201*b*, ink may adhere to the platen plate 215, and the recording medium 216 will be stained. The non-recording areas 201*b* are used in order to avoid this problem.

However, with the structure of the conventional example described above, there are problems encountered as described below when transmitted images are made for medical use, for example.

FIG. 19 is a view which shows one example of a transmitted image 204 for medical use where recording is effected on a transparent recording medium by use of the conventional ink jet recording apparatus. Also, FIG. 20 is a view which shows the state where transmitted images 204 and 204' are arranged side by side on a light box 205 for observation.

On the circumference of the image areas 204*a*, an area, which is called a border 204*b*, is formed where areas other than images are covered with black color in high density. Further, on the circumference of the border 204*b*, transparent areas having no recording on them are formed as the non-recording areas 204*c*, 204*d*, 204*e*, and 204*f*.

As shown in FIG. 20, the transmissive image 204 is in a state where it is inserted on the upper portion of the front face of the light box 205. Then, the image area 204*a* is observed by applying back light to the reverse side of the transmissive image 204 from the light box 205. Therefore, in a case of a silver salt photograph, all the portions other than medical images are treated as the borders. When this photograph is observed in the light box 205, unwanted light is blocked. This is because intensified light is emitted from the unwanted transparent portions, if any, and the intended observation is hindered on the portions that should be examined precisely.

Here, the transmissive image 204, which is recorded by use of the conventional ink jet recording apparatus, presents the transparent areas 204*c*, 204*d*, 204*e*, and 204*f* which are formed on the circumference of the border 204*b* without any recorded images. When a transmitted image 204 of this kind is mounted on the light box 205 for observation, the light that transmits through the non-recording areas 204*d* and 204*e* on both edges, respectively, in particular, hits the eyes of the observer to hinder the precise observation of the image area 204*a*. Also, as shown in FIG. 20, plural numbers of transmitted images 204 and 204' are often observed at one time. In this case, when each of the image areas 204*a* and 204*a*' of the respective transmissive images 204 and 204' is intently observed one after another, such gaze of the observer may shift across the transmissive image 204 and the transmissive image 204'. Then, the eyes of the observer, which have gazed upon the weaker luminous energy on the image area are dazzled by the intense light that transmits through the transparent marginal portions of the non-recording areas 204*e* and 204*d*, hence making it impossible, in some cases, to perceive the minute change of luminous energies on the image areas 204*a* and 204*a*' to be observed next.

As an apparatus that may be able to solve the problems discussed above, an ink jet printer is disclosed in the specification of Japanese Patent Application Laid-Open No. 8-169155, wherein on the lower side of the printing head of such printer, there is provided an ink collection container having a sufficient width which is larger than the width of a recording sheet to be carried across the range of the printing head reciprocation.

Nevertheless, the ink jet printer disclosed in the specification of the aforesaid laid-open application does not provide any guiding members that guide a recording sheet over the entire width of the recording sheet on the lower side of the printing head, and the recording sheet is carried in a state where it floats in the air. As a result, the behavior of the recording sheet is unstable. Further, the behavior of the recording sheet becomes more unstable when the ink droplets discharged from the printing head are absorbed into the recording sheet, hence presenting an unfavorable problem that the quality of recorded images is degraded.

SUMMARY OF THE INVENTION

It is an object of the present invention to provide an ink jet recording apparatus capable of recording up to the edges of a recording medium in high quality, and also, to provide an ink jet recording method therefor.

It is another object of the present invention to provide an ink jet recording apparatus which comprises carrying means for carrying a recording medium; a head installation unit for a recording head to record on the recording medium by discharging ink from discharge ports, which reciprocates in the width direction intersecting the carrying direction of the recording medium; supporting means for supporting the recording medium in a position facing the recording head; and opening portions for collecting ink discharged from the recording head at the edges of the recording medium in the width direction.

It is still another object of the present invention to provide an ink jet recording apparatus which comprises carrying means for carrying a recording medium in the carrying direction of the recording medium, a head installation unit for mounting the recording head to record on the recording medium, which discharges ink from a plurality of discharge ports arranged in a range exceeding the passage area of the recording medium in the width direction intersecting the carrying direction; supporting means for supporting the recording medium in a position facing the recording head; and opening portions for collecting ink discharged from the recording head at the edges of the recording medium in the width direction.

DETAILED DESCRIPTION OF THE PREFERRED EMBODIMENTS

Now, with reference to the accompanying drawings, the description will be made of the embodiments in accordance with the present invention.

(First Embodiment)

Figure 1:
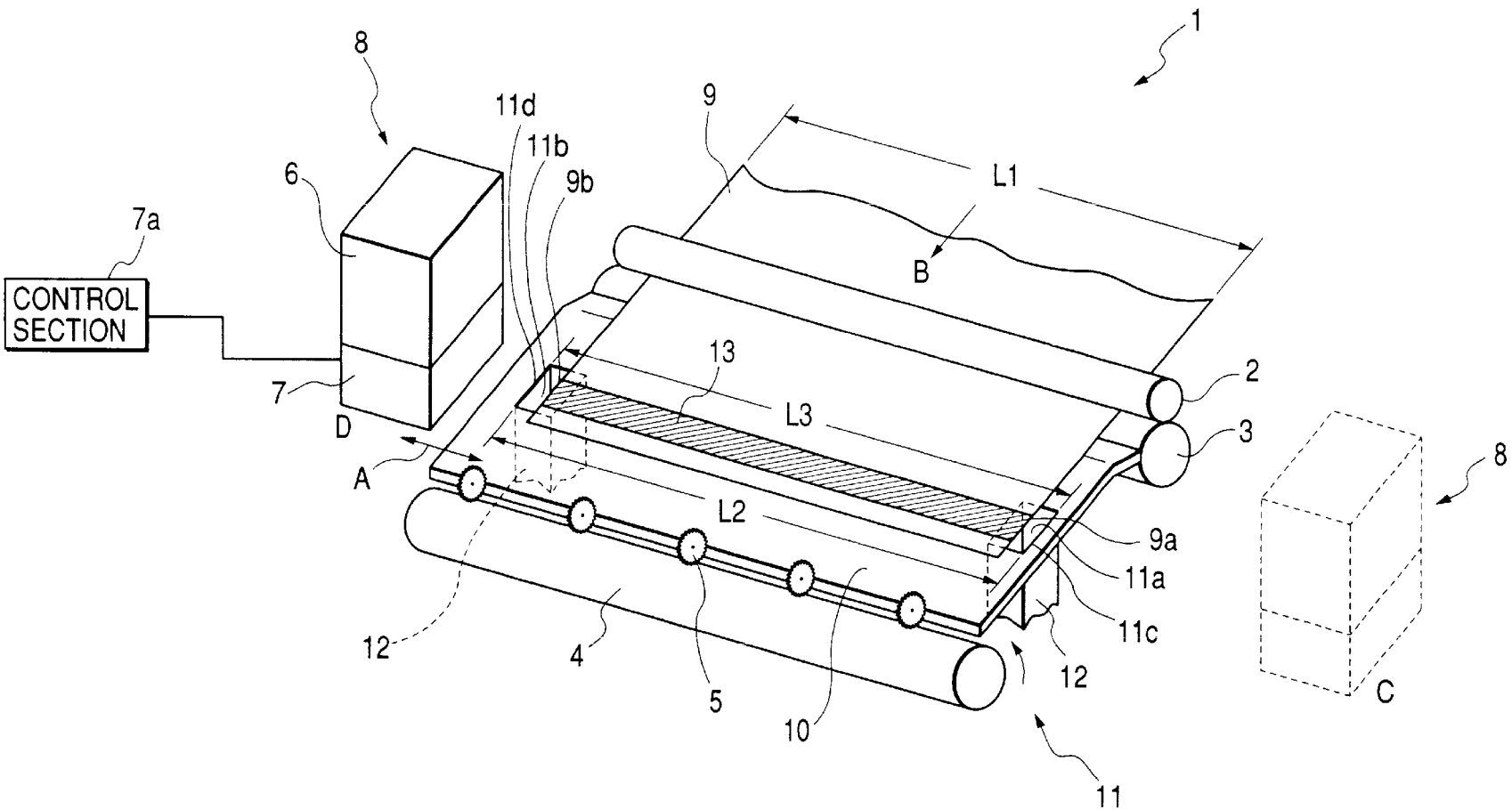
FIG. 1 is a respective view which schematically shows the structure of the recording unit of an ink jet recording apparatus in accordance with a first embodiment of the present invention.

FIG. 1 is a perspective view which schematically shows the structure of the recording unit 19 of an ink jet recording apparatus 1 in accordance with a first embodiment of the present invention.

The recording unit 19 of the ink jet recording apparatus 1 of the present embodiment comprises a carriage that serves as the head installation unit (not shown) for mounting the ink jet recording head cartridge 8, first sub-scanning rollers 2 and 3 and second sub-scanning rollers 4 and 5 to carry the recording medium 9 which is capable of transmitting light, an ink tank 6 and a recording head 7, a platen plate 10 having ink receiving ports 11*a* and 11*b* formed therein, and a control unit 7*a* that controls ink discharge from the recording head 7.

The first sub-scanning rollers 2 and 3 are arranged to nip a recording medium 9 and carry the recording medium 9 onto the upper face of the platen plate 10. The second sub-scanning rollers 4 and 5 are arranged to nip the recording medium 9 after recording, and exhaust the medium to a recording medium receptacle (not shown). Roller 5 of the second sub-scanning rollers is in contact with the recording medium 9 immediately after recording. Therefore, this roller is in the form of a spur in order to avoid the adhesion of wet ink.

The ink tank 6 stores ink therein. The recording head 7 has a plurality of discharge ports formed in the sub-scanning direction (indicated by an arrow B in FIG. 1), which is the carrying direction of the recording medium 9. For recording, the carriage that has the ink jet recording head cartridge 8 mounted thereon is arranged to reciprocate in the main scanning direction (indicated by an arrow A in FIG. 1), which is orthogonal to the direction that intersects the sub-scanning direction, for example, along the carriage guide (not shown) arranged substantially in parallel with each rotational shaft of the sub-scanning rollers. The recording head 7 performs recording while reciprocating between the position D indicated by the solid line in FIG. 1 and the position C indicated by the broken line therein. Also, the ink jet recording head cartridge 8 is capable of discharging ink in the range $L_3$ where ink is discharged, which is wider than the range $L_1$ between the right edge 9*a* and left edge 9*b* of the recording medium 9.

The two ink receiving ports 11*a* and 11*b* formed in the platen plate 10 communicate with an ink absorbent or an ink tank (not shown) that stores unwanted ink by way of tubes 12. Also, the positions where the ink receiving ports 11*a* and 11*b* are formed are directly below the path of the recording head 7. At the same time, the gap $L_2$, which is between the outer side end 11*c*, namely, the outer edge, of the ink receiving port 11*a* and the outer end 11*d*, namely, the outer edge of the ink receiving port 11*b*, is made wider than the range $L_3$ where ink is discharged. In other words, the relationship between the width $L_1$ of the recording medium 9, the gap $L_2$ between the outer edge 11*c* and the outer edge 11*d*, and the ink discharging range $L_3$ is as follows:

$$L_1 < L_3 < L_2.$$

The ink receiving port 11*a* corresponds to the right edge 9*a* of the recording medium 9, while the ink receiving port 11*b* corresponds to the left edge 9*b* of the recording medium 9.

Now, a detailed description will be made of a method for recording on the recording medium 9 by use of the ink jet recording apparatus 1 in accordance with the present embodiment.

Here, the description relates to the case where border 13 is recorded on the recording medium 9, while the carriage having the ink jet recording head cartridge 8 mounted thereon moves from the position C to the position D.

The recording medium 9 is nipped by the first sub-scanning rollers 2 and 3 and carried onto the upper face of the platen plate 10.

The carriage moves from the position C toward the position where the ink receiving port 11*a* is located. Then, the recording head 7 begins discharging ink in accordance with the controlling signals from the control unit 7*a* when the head arrives in a location within the projected position of the ink receiving port 11*a*, but the discharge ports of the recording head 7 are yet to reach the projected position of the recording medium 9. In other words, when the recording head 7 comes into the range $L_3$ in FIG. 1, ink begins to is be discharged to the ink receiving port 11*a*. This means that ink is discharged to the area outside the recording medium 9. However, the ink thus discharged outside the recording medium 9 is collected by the ink receiving port 11*a* so that the platen plate 10 is not stained. The recording medium 9 which is carried on the platen plate 10 is not stained, either. Also, the ink that has been discharged at this juncture is exhausted to the ink absorbent or the ink tank that stores unwanted ink through the tube 12.

The carriage further moves to the position D while discharging ink continuously from the recording head 7 in accordance with the control signals from the control unit 7*a*. In this manner, the recording of the border 13 begins with the right edge 9*a* without the formation of a non-recording area on the recording medium 9. Then, the carriage passes the left edge 9*b* of the recording medium 9, while the recording head 7 discharges ink to complete recording of the border 13 on the recording medium 9 and ink discharge is performed up to the outer edge 11*d* of the ink receiving port 11*b*. In this way, it becomes possible to eliminate the formation of a non-recording area on the left edge 9*b* of the recording medium 9. Thus, each border 13 is formed on the edges of the recording medium 9 without the formation of the non-recording areas on them.

After recording the borders 13, the recording head 7 terminates ink discharging within the range of $L_3$ in FIG. 1 before the discharge ports arrive at the outer edge 11*d* of the ink receiving port 11*b*. Therefore, there is no possibility that the platen plate 10 is stained by the discharged ink. Also, the ink that has been discharged then is exhausted to the ink absorbent or to the ink tank that stores unwanted ink through the tube 12.

Figure 2:
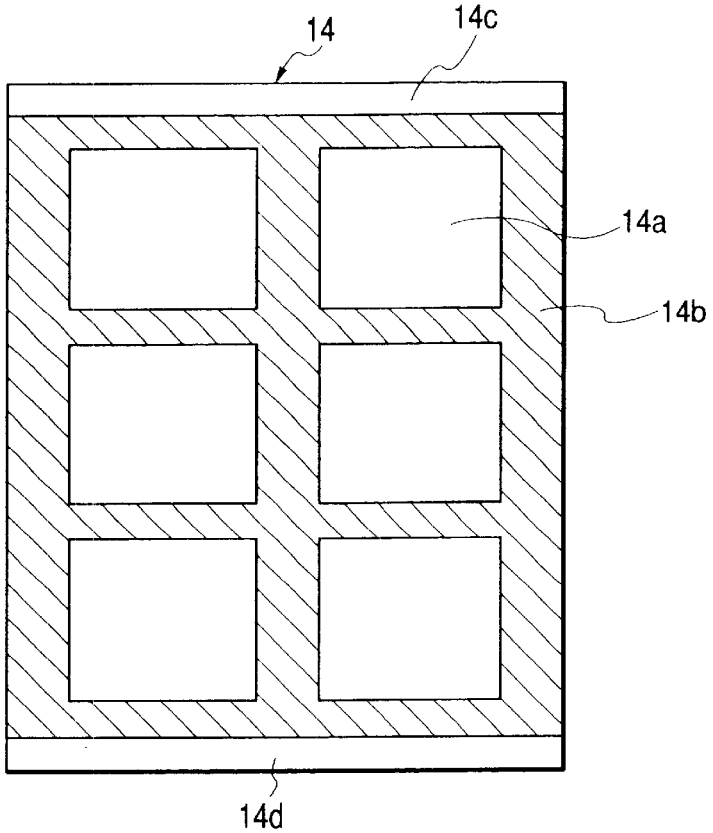
FIG. 2 is a view which shows one example of the transmissive image for medical use, which is recorded by recording the ink jet recording apparatus in accordance with the first embodiment of the present invention.

FIG. 2 is a view which shows one example of the transmissive image 14 for medical use, which is recorded by the ink jet recording apparatus 1 in accordance with the present embodiment.

Figure 19:
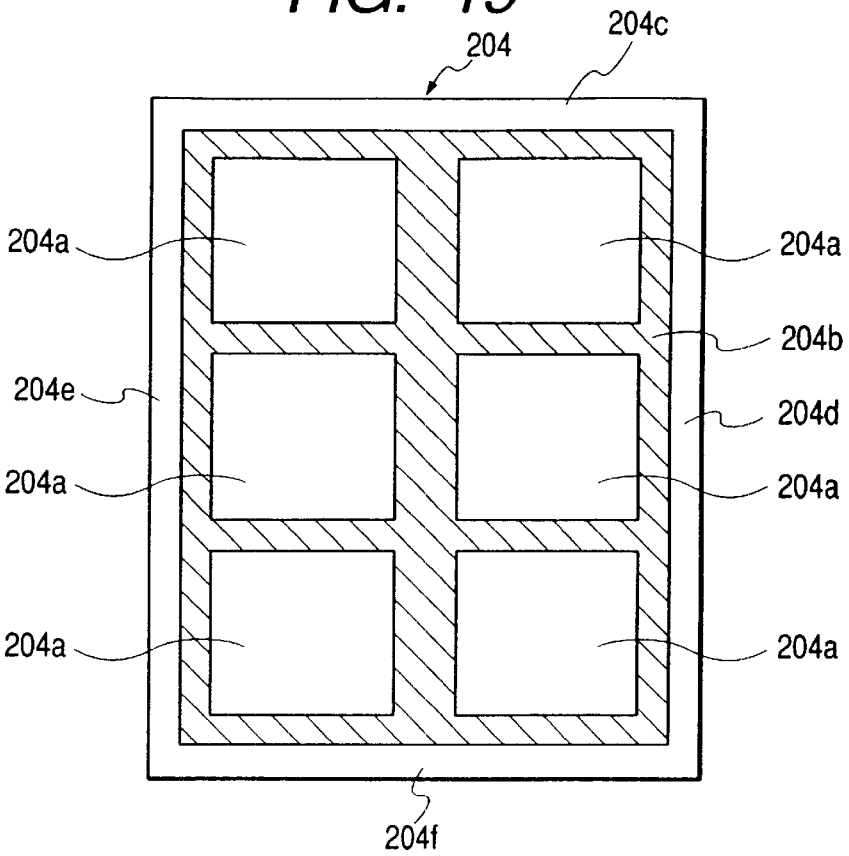
FIG. 19 (PRIOR ART)
FIG. 19 is a view which shows one example of the transmissive image for medical use, which is recorded by the conventional ink jet recording apparatus.
Figure 20:
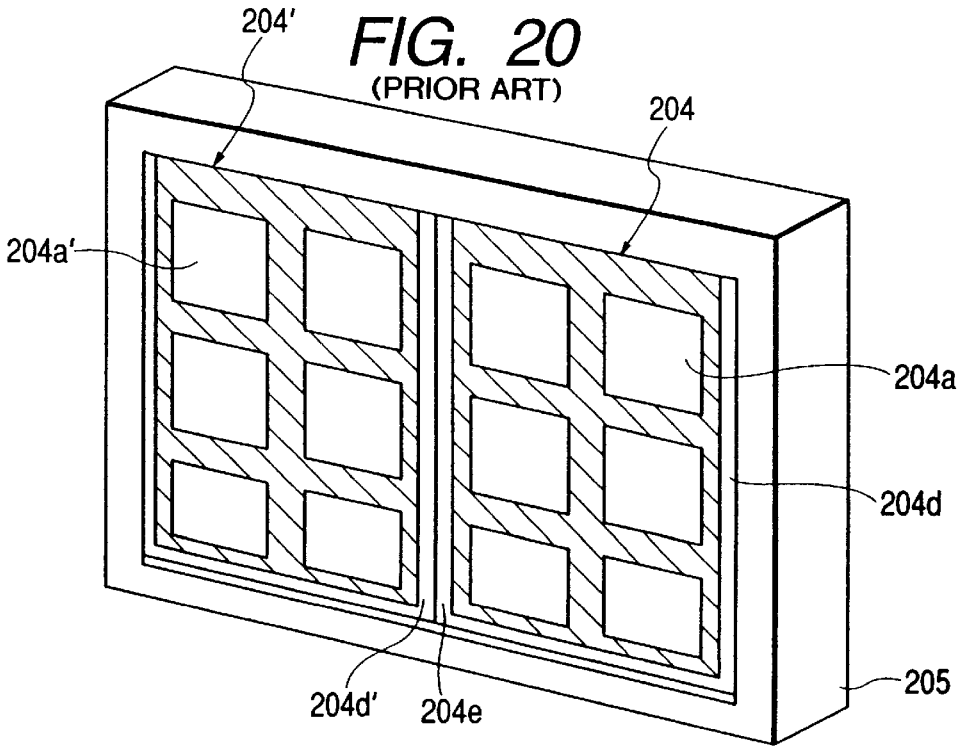
FIG. 20 (PRIOR ART)
FIG. 20 is a view which shows the state where plural numbers of transmissive images are arranged side by side for observation by use of a light box in accordance with the conventional art.

On an area other than the image area 14*a*, the border 14*b* is formed with black color in high density. Here, whereas the transmissive image 204 recorded by the conventional ink jet recording apparatus shown in FIG. 19 has non-recording areas 204*c*, 204*d*, 204*e*, and 204*f* each on the upper, lower, left, and right edges, respectively, the transmissive image 14 formed by the ink jet recording apparatus 1 of the present embodiment has non-recording areas 14*c* and 14*d* only on the upper and lower edges. On the left and right edge the borders 14*b* are covered, respectively, entirely with black color.

Figure 3:
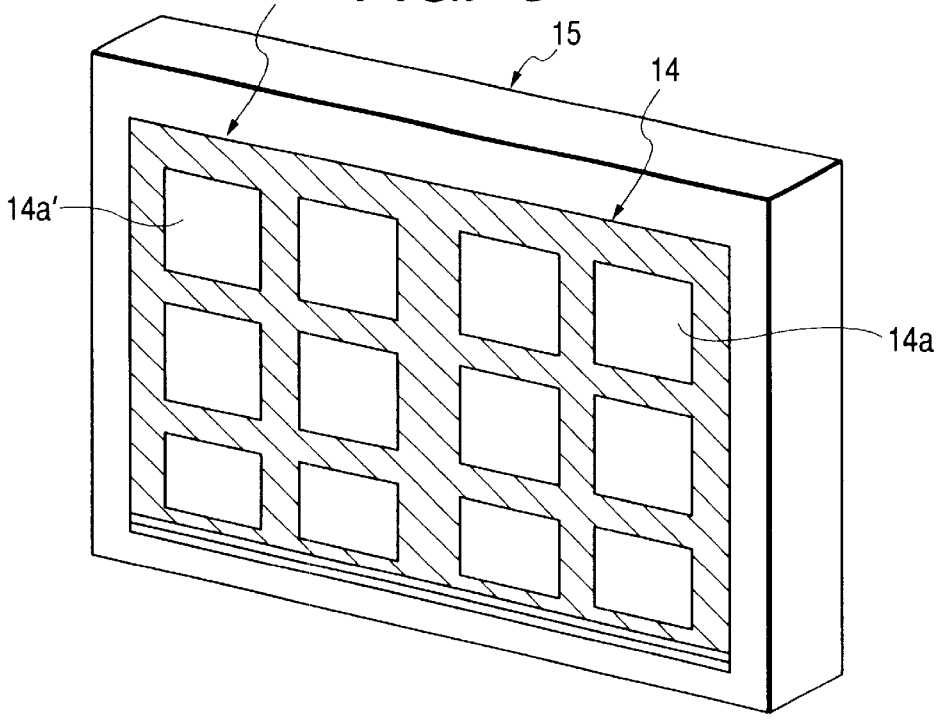
FIG. 3 is a view which shows the state where plural numbers of transmissive images are arranged side by side for observation by use of a light box.

FIG. 3 is a view which shows the state where a transmissive image 14*a* and a transmissive image 14*a*', which is formed in the same way as the transmissive image 14*a*, are arranged side by side for observation by use of a light box 15.

Since there are no transparent portions on the left and right edges of the transmissive image 14*a* and the transmissive image 14*a*', no gap is formed between the transmissive images 14*a* and 14*a*', which may allow the back light to pass from the light box 15.

Figure 4:
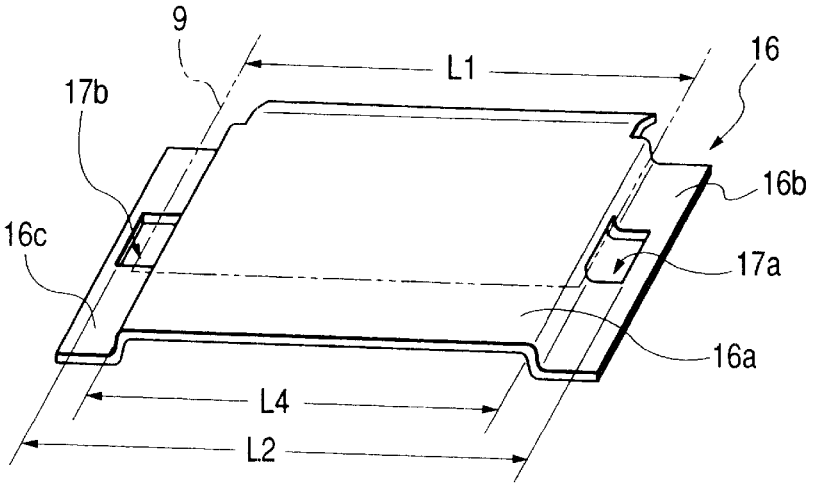
FIG. 4 is a view which shows one example of a differently configured platen plate.

In this respect, the description has been made of the platen plate 10 in accordance with the flat plate type as one example. However, the platen plate is not necessarily limited thereto. It may be possible to use one which is configured as the platen plate 16 shown in FIG. 4, for example.

In other words, the width $L_4$ of the contact surface 16*a* of the platen plate 16, which is in contact with the recording medium 9, is formed narrower than the width $L_1$ of the recording medium 9. Also, both ends of the platen plate 16 are provided with stepped portions 16*b* and 16*c* which are shaped to present steps below the contact surface 16*a*. The relationship between $L_1$, $L_3$, $L_2$, and $L_4$ is as follows:

$$L_4<L_1<L_3<L_2,$$

where the platen plate 16 is used. With the stepped portions 16*b* and 16*c* being positioned below the contact surface 16*a*, there is no possibility that these portions are in contact with the recording medium 9. Also, the ink receiving ports 17*a* and 17*b* are formed in the stepped portions 16*b* and 16*c*, respectively, so the recording medium 9 is not stained when the recording medium 9 is in contact with the left and right edges even if the ink receiving ports 17*a* and 17*b* are stained with ink, because the stepped portions 16*b* and 16*c* are not in contact with the recording medium 9 as described above.

It may also be possible to use a plate member provided with linear extrusions or an embossed plate member, rather than one configured like platen plate 10 or 16.

As has been described above, the ink jet recording apparatus 1 of the present embodiment is provided with the ink receiving ports 11*a* and 11*b* (or 17*a* and 17*b*) which are formed in the platen plate 10 (or 16) corresponding to each of the left and right edges of the recording medium 9, and ink begins to be discharged immediately before the recording head 7 arrives at the right edge of the recording medium 9. Then, ink is continuously discharged until the recording head 7 passes the left edge of the recording medium 9. Therefore, it becomes possible to form the borders 13 each on the left and right edges of the recording medium 9, which are completely blackened. As a result, even when a plurality of transmissive images 14 recorded by the ink jet recording apparatus 1 of the present embodiment are arranged side by side on the light box 15, it becomes possible for the observer to perceive the minute change of luminous energies on the image areas without being dazzled by the intensive light that breaks through the transparent marginal portions formed by the non-recording areas even if his eyes pass across the transmissive image, while he is engaged in gazing each of the image areas 14*a* of each transmissive image 14 one after another.

(Second Embodiment)

Figure 5:
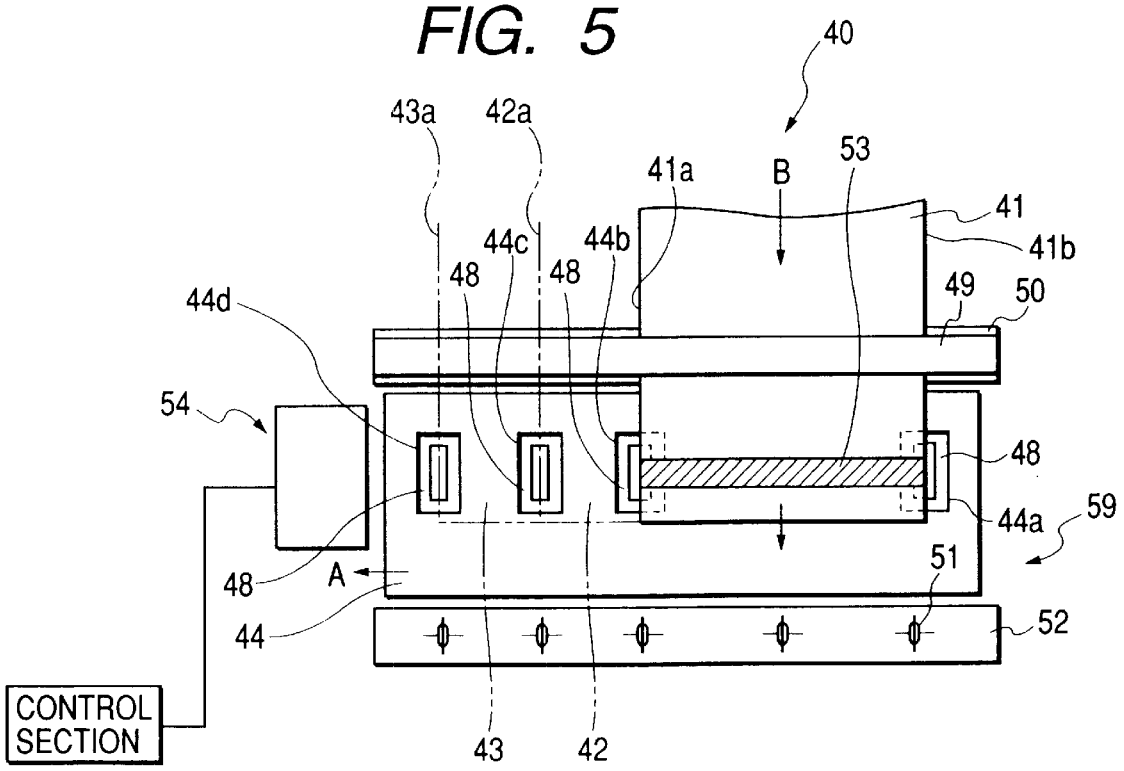
FIG. 5 is a plan view which schematically shows the structure of an ink jet recording apparatus in accordance with a second embodiment of the present invention.
Figure 6:
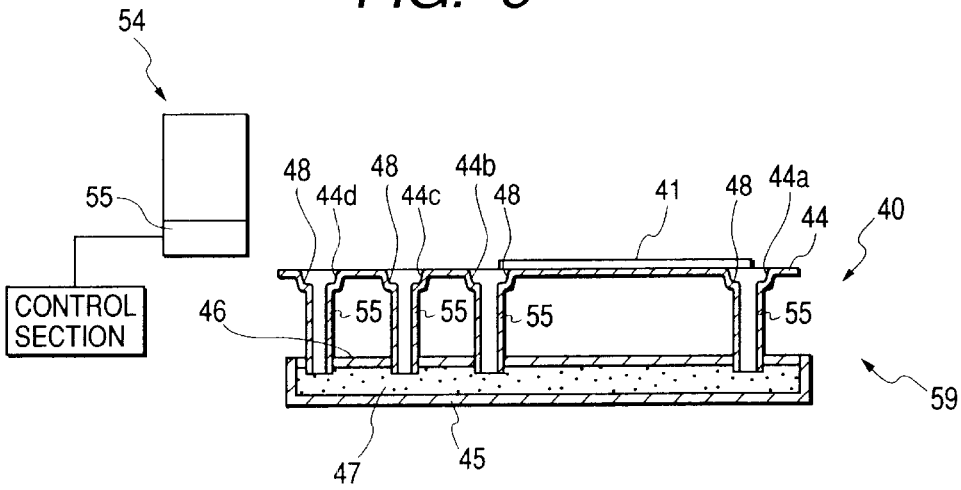
FIG. 6 is a cross-sectional view which schematically shows the structure of the ink jet recording apparatus represented in FIG. 5.

Now, FIG. 5 and FIG. 6 are views which schematically illustrate the structure of the recording unit 59 of an ink jet recording apparatus 40 in accordance with a second embodiment of the present invention. FIG. 5 is a plan view and FIG. 6 is a cross-sectional view, respectively.

In the platen plate 44 of the ink jet recording apparatus 40 of the present embodiment, there are formed a first ink receiving port 44*a* at a position corresponding to the right edge 41*b* of each recording medium of different widths, and which has been carried to that position; a second ink receiving port 44*b* at a position corresponding to the left edge of each recording medium of a particular width; a third ink receiving port 44*c*; and a fourth ink receiving port 44*d*.

The second ink receiving port 44*b* is formed at a position that corresponds to the left edge 41*a* of a first recording medium 41. The third ink receiving port 44*c* is formed at a position that corresponds to the left edge 42*a* of a second recording medium 42 which is wider than the first recording medium 41. The fourth ink receiving port 44*d* is formed at a position that corresponds to the left edge 43*a* of a third recording medium 43 which is wider than the second recording medium 42.

Also, each of the ink receiving ports 41*a*–44*d* communicates with a corresponding one of tubes 55. Between each ink receiving port 41*a*–41*d* and each tube 55, a recessed portion 48 is formed on the surface of the platen plate 44. With the recessed portions 48 thus formed, it is possible to prevent the adhesion of unwanted ink to each recording medium to be used.

Below the platen plate 44, an ink absorbent case 45 is arranged to contain an ink absorbent 47, thus absorbing and retaining the ink which has flowed into each tube 55 extruded into the ink receiving ports. The ink absorbent case 45 is provided with a cover 46 so as not to allow the absorbed ink to leak out.

In this respect, the ink absorbent or the ink tank that stores unwanted ink in the first embodiment, which is not shown in the figures of the first embodiment, can be the same as the ink absorbent case 45 with the cover 46 that contains the ink absorbent 47 as shown in FIG. 6.

With the structure thus arranged, the first recording medium 41 that has been carried by first sub-scanning rollers 49 and 50 is provided with borders 53 on the left and right edges thereof covered with black ink discharged from recording head 55 of the ink jet recording head cartridge 54 in high density without any marginal portions thereon. In this case, the range of ink discharged from the recording head 56 is between the first ink receiving port 44*a* and the second ink receiving port 44*b*, and there is no possibility that the platen plate 44 and the first recording medium 41 are stained.

Likewise, when recording is performed on the second recording medium 42, the range of ink discharged from the recording head 55 is between the first ink receiving port 44*a* and the third ink receiving port 44*c*. When recording is performed on the third recording medium 43, the range of ink discharged from the recording head 55 is between the first ink receiving port 44*a* and the fourth ink receiving port 44*d*. As a result, there is no possibility in any case that the platen plate 44, the second recording medium 42, and the third recording medium 43 are stained.

The structure and operation of the ink jet recording apparatus 40 of the present embodiment are fundamentally the same as those of the ink jet recording apparatus 1 described in the first embodiment with the exception of what has been described so far. Therefore, any further detailed description thereof will be omitted.

Further, in this respect, the description has been made of the platen plate 44 exemplifying the flat plate type. However, the platen plate is not necessarily limited thereto. It may be possible to arrange each portion of the ink receiving ports to be configured not in contact with each recording medium to be used. For example, a plate member having linear extrusions or an embossed plate member may be adoptable.

As described above, it is possible for the ink jet recording apparatus 40 of the present embodiment to record without forming any marginal portions on the left and right edges of each recording medium as in the case of the ink jet recording apparatus of the first embodiment.

(Third Embodiment)

Figure 7:
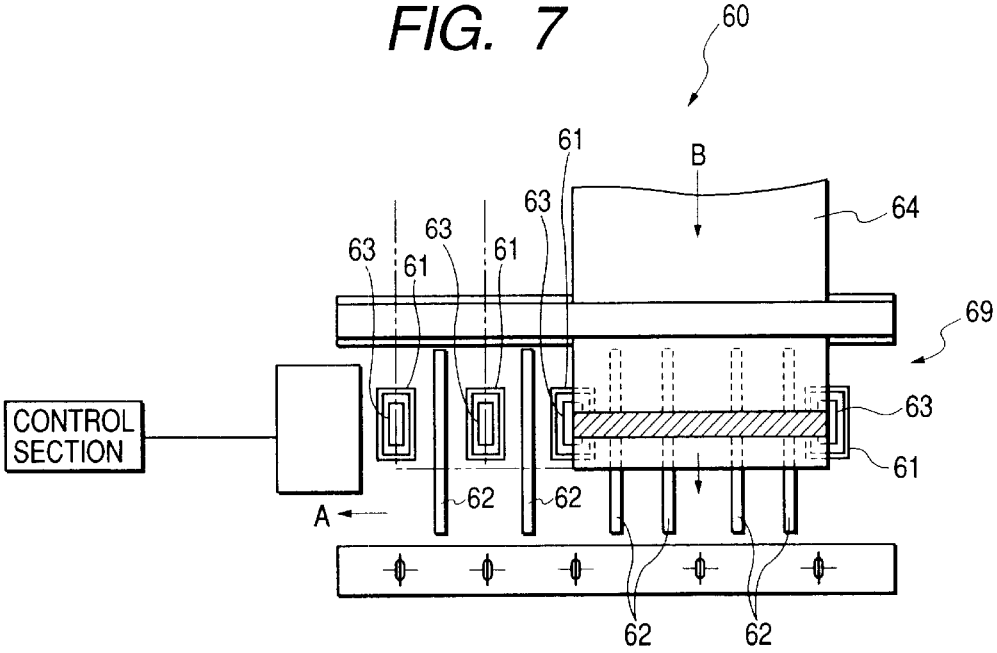
FIG. 7 is a plan view which schematically shows the structure of an ink jet recording apparatus in accordance with a third embodiment of the present invention.
Figure 8:
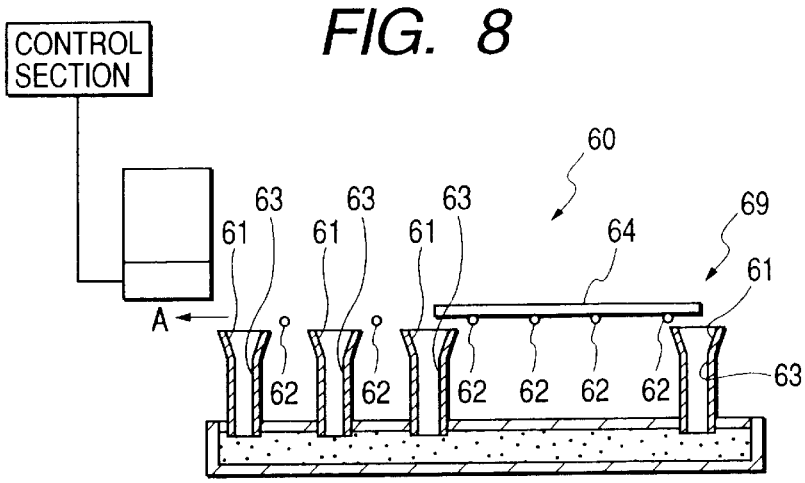
FIG. 8 is a cross-sectional view which schematically shows the structure of the ink jet recording apparatus represented in FIG. 7.

FIG. 7 and FIG. 8 are views which schematically illustrate the structure of the recording unit 69 of an ink jet recording apparatus 60 in accordance with a third embodiment of the present invention. FIG. 7 is a plan view and FIG. 8 is a cross-sectional view.

The platen plate of the ink jet recording apparatus 60 of the present embodiment is not the flat type like the platen plate 44 used for the ink jet recording apparatus 40 of the second embodiment. For this platen plate, a plurality of thin wire-like bars 62 are arranged in parallel in the main scanning direction, assuming that the sub-scanning direction is the longitudinal direction. Also, each of the bars 62 is arranged so as not to interfere with each of the receiving ports 61, which will be described later. Each of the ink receiving ports 61 is tapered with a sectional area at its opening being wider than the sectional area of connected tube 63. With this configuration, it becomes easier to collect the ink which has been discharged through the air. Also, each of the opening edges of the ink receiving ports 61 is positioned lower than that of each bar 62. As a result, there is no possibility that the recording medium 64 and each opening edge of the ink receiving ports 61 are in contact with each other.

The structure and operation of the ink jet recording apparatus 60 of the present embodiment are fundamentally the same as those of the ink jet recording apparatus 40 described in the second embodiment with the exception of what has been described so far. Therefore, any further detailed description thereof will be omitted.

As described above, not only does the ink jet recording apparatus 60 of the present embodiment have a lesser amount of area in which it is in contact with a recording medium, but also this apparatus can support each recording medium with the bars 62 each having a lesser amount of area of possible ink adhesion. Therefore, it becomes possible to record without forming any marginal portions on the left and right edges of each recording medium as in the case of the ink jet recording apparatuses of the first and second embodiments.

(Fourth Embodiment)

Figure 9:
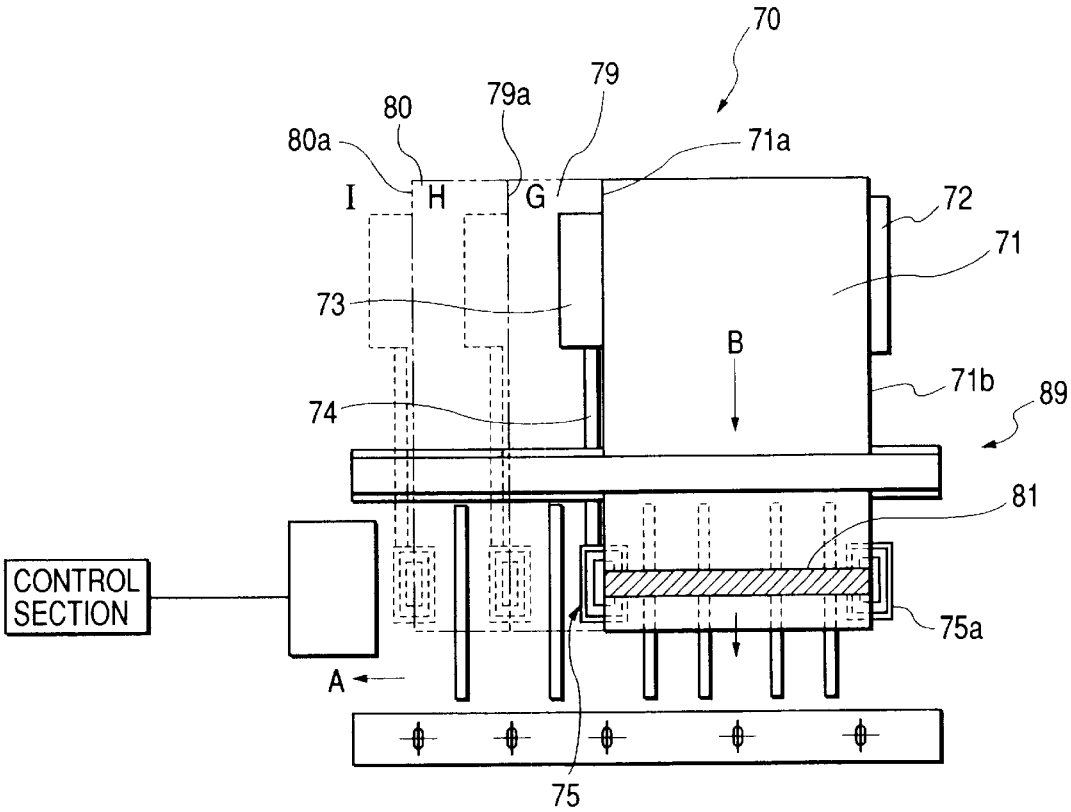
FIG. 9 is a plan view which schematically shows the structure of an ink jet recording apparatus in accordance with a fourth embodiment of the present invention.
Figure 10:
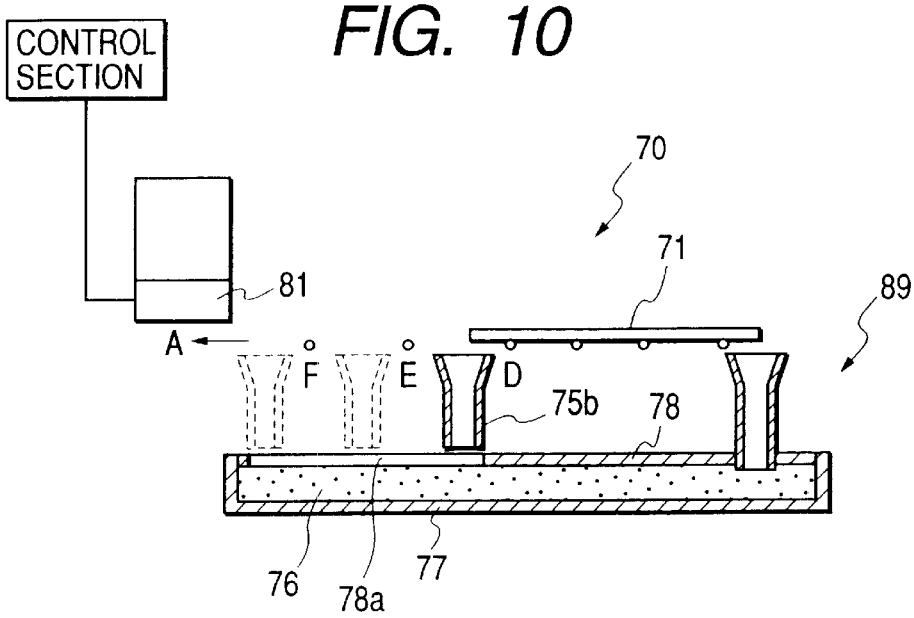
FIG. 10 is a cross-sectional view which schematically shows the structure of the ink jet recording apparatus represented in FIG. 9.

Now, FIG. 9 and FIG. 10 are views which schematically illustrate the structure of the recording unit 89 of an ink jet recording apparatus 70 in accordance with a fourth embodiment of the present invention. FIG. 9 is a plan view and FIG. 10 is a cross-sectional view.

The ink jet recording apparatus 70 of the present embodiment is provided with ink receiving port 75 having an ink receiving opening formed therefor, which is connected by a rod 74 with a second positioning plate 73 arranged corresponding to a first positioning plate 72 that regulates the right edge 71*b* of each recording medium. The second positioning plate 73 moves in parallel in the main scanning direction. This plate is made freely fixable in order to conduct positional regulation of the left edge of each recording medium. The ink receiving port 75 which is connected by the rod 74 with the second positioning plate 73 is of course movable in the main scanning direction along with the second positioning plate 73.

In cover 78 of ink absorbent case 77 that contains ink absorbent 76, an opening 78*a* is formed corresponding to the movable range of the ink receiving port 75. In other words, the opening 78*a* is formed so that the collected ink, which has been discharged from the tube 75*a* communicating with the ink receiving port 75, can flow into the ink absorbent 76 in the ink absorbent case 77 irrespective of the position in which the ink receiving port 75 is set within its movable range.

Now, description will be made of the procedures to set the position of the ink receiving port 75 corresponding to each size of recording medium to be used.

When a border 81 is to be formed on a first recording medium 71, the operator shifts the second positioning plate 73 to a position equal to the left edge 71*a* of the first recording medium. Then, the ink receiving port 75 connected by the rod 74 is set at the position (designated by a reference mark G in FIG. 9) that corresponds to the left edge 71*a* of the first recording medium.

Likewise, when recording is to be effected on a second recording medium 79 which is wider than the first recording medium 71, the operator shifts the second positioning plate 73 to the position equal to the left edge 79*a* of the recording medium. Thus, the ink receiving port 75 is set at the position (at H in FIG. 9) that corresponds to the left edge 79*a* of the second recording medium.

When recording is to be effected on a third recording medium 80 which is wider than the second recording medium 79, the same kind of operation is carried out to set the ink receiving port 75 at the position (at I in FIG. 9) that corresponds to the left edge 80*a* of the third recording medium.

When the ink receiving port 75 is at any one of the G, H, and I positions shown in FIG. 9, the ink, which is discharged from the recording head 81 to the ink receiving port 75, can flow into the ink absorbent 76 from the opening 78*a* by way of the tube 75*b*, hence being absorbed and retained therein.

The structure and operation of the ink jet recording apparatus 70 of the present embodiment are fundamentally the same as those of the ink jet recording apparatus 60 described in the third embodiment with the exception of what has been described so far. Therefore, any further detailed description thereof will be omitted.

In this respect, description has been made of recording media of only three widths, and also, of the ink receiving port 75 which is positioned and set only in three different stages. However, the invention is not necessarily limited to three. Also, for the present embodiment, the structural example is shown in which only the ink receiving port 75 that corresponds to the left edge of each recording medium is movable. However, it may be possible to arrange the structure so that the ink receiving port 75*a* that corresponds to the right edge of each recording medium is movable.

As described above, it is possible for the ink jet recording apparatus 70 of the present embodiment to record without forming any marginal portions on the left and right edges of each recording medium as in the case of the ink jet recording apparatuses of the first to third embodiments.

(Fifth Embodiment)

Figure 11:
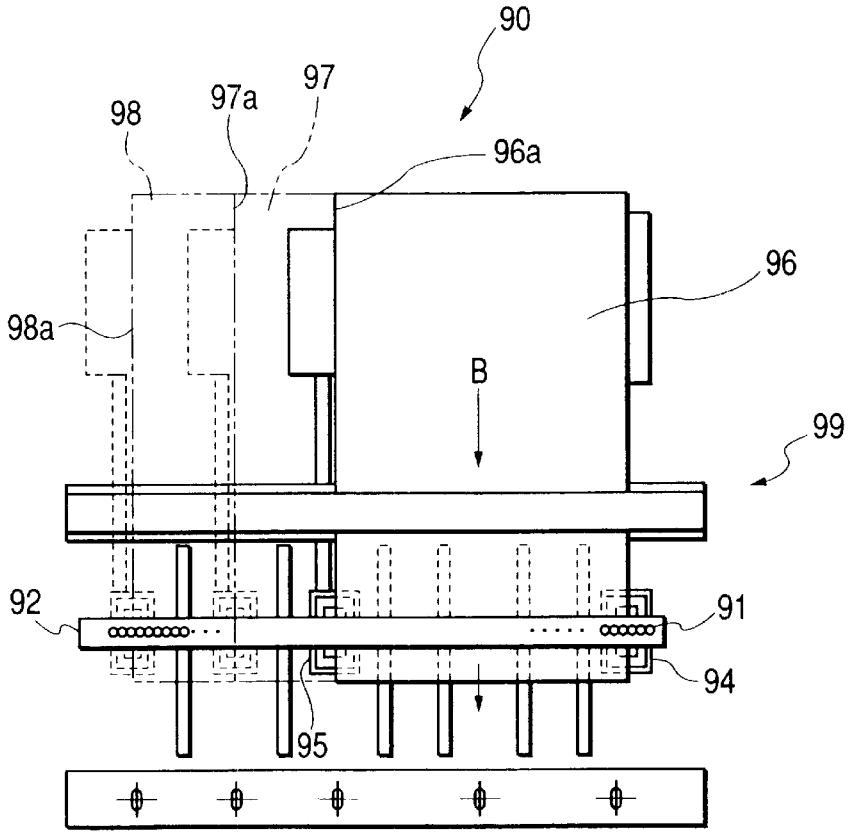
FIG. 11 is a plan view which schematically shows the structure of an ink jet recording apparatus in accordance with a fifth embodiment of the present invention.
Figure 12:
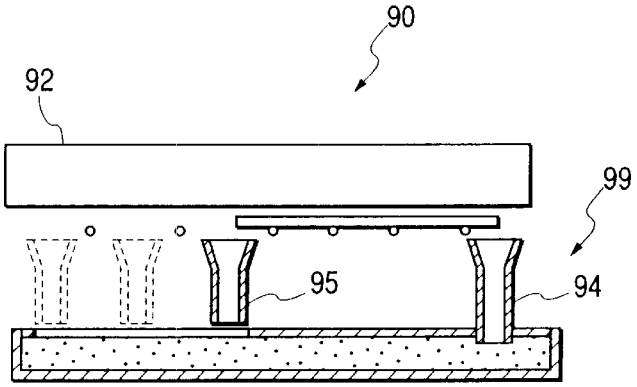
FIG. 12 is a cross-sectional view which schematically shows the structure of the ink jet recording apparatus represented in FIG. 11.

Now, FIG. 11 and FIG. 12 are views which schematically illustrate the structure of the recording unit 99 of an ink jet recording apparatus 90 in accordance with a fifth embodiment of the present invention. FIG. 11 is a plan view and FIG. 12 is a cross-sectional view.

The ink jet recording apparatus 90 of the present embodiment is of the so-called line head type, which is provided with a line head 92 having a nozzle array 91 formed across the entire recording area in the sub-scanning direction for ink discharge. The line head 92 is detachably mounted on the head installation unit which is not shown. The nozzle array 91 is formed for the line head 92 on the side that faces each recording medium which will be described later. Also, the line head 92 is fixed to the main body (not shown) of the ink jet recording apparatus 90 by means of a fixing member (also not shown).

The ink discharging range of the nozzle array 91 of the line head 92 that records on a first recording medium 96 is between a first ink receiving port 94 and a second ink receiving port 95 which is set at a position corresponding to the left edge 96*a* of the first recording medium.

Also, when recording is to be effected on a second recording medium 97 which is wider than the first recording medium 96, the ink discharging range of the nozzle array 91 of the line head 92 is between the first ink receiving port 94 and the second ink receiving port 95 which is set at a position corresponding to the left edge 97*a* of the second recording medium.

Likewise, when recording is to be effected on a third recording medium 98 which is wider than the second recording medium 97, the ink discharging range of the nozzle array 91 of the line head 92 is between the first ink receiving port 94 and the second ink receiving port 95 which is set at a position corresponding to the left edge 98*a* of the third recording medium.

As described above, the distance from the first ink receiving port 94 to the second ink receiving port 95 which is set corresponding to the width of each medium becomes the range within which ink is discharged from the nozzle array 91 of the line head 92.

The structure and operation of the ink jet recording apparatus 90 of the present embodiment are fundamentally the same as those of the ink jet recording apparatus 70 described in the fourth embodiment with the exception of what has been described so far. Therefore, further detailed description thereof will be omitted.

In this respect, description has been made of recording media of only three widths, and also, of the ink receiving port 95 which is positioned and set only in three different stages. However, the invention is not necessarily limited to three. Also, for the present embodiment, the structural example is shown in which only the ink receiving port 95 that corresponds to the left edge of each recording medium is movable. However, it may be possible to arrange the structure so that the first ink receiving port 94 that corresponds to the right edge of each recording medium is movable.

As described above, it is possible for the ink jet recording apparatus 90 of the present embodiment to record without forming any marginal portions on the left and right edges of each recording medium as in the case of the ink jet recording apparatuses of the first to fourth embodiments.

(Sixth Embodiment)

Figure 13:
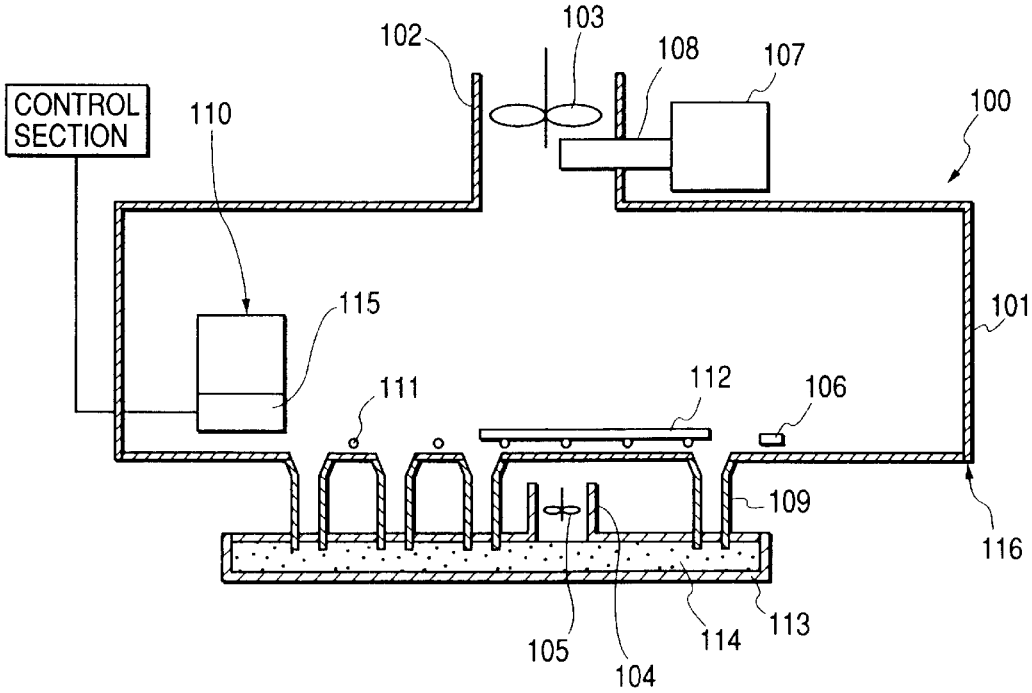
FIG. 13 is a cross-sectional view which schematically shows the structure of the ink jet recording apparatus represented in accordance with a sixth embodiment of the present invention.

FIG. 13 is a cross-sectional view which schematically shows the recording unit 116 of an ink jet recording apparatus 100 in accordance with a sixth embodiment of the present invention.

The ink jet recording apparatus 100 of the present embodiment comprises a cover 101 provided with a first duct 102, which covers an ink jet recording cartridge 110 and bars 111; a first fan 103 installed in the first duct 102; a humidifier 107 for preventing the viscosity of ink from being raised, and which is provided with a humidifying nozzle 108 in the first duct 102; and a humidity sensor 106 that detects the humidity within the cover 101. Also, ink absorbent case 113 is provided with a second duct 104. In the second duct 104, a second fan 105 is installed.

The first fan 103 induces air into the cover 101, and is driven by a motor (not shown). The humidifier 107 emits steam from the humidifying nozzle 108 to humidify the air introduced from the first fan 103. The humidity of the air introduced by the first fan 103 and humidified by the humidifier 107 is detected by the humidity sensor 106. The humidifier 107 is controlled to make the humidity level within the interior of the cover 101 as desired in accordance with signals transmitted from a humidifier controller (not shown) that operates based upon the detected signals transmitted from the humidity sensor 106. The air which has made the humidity level within the interior of the cover 101 as desired is arranged to flow into the ink absorbent 114 through the ink receiving port 109. The air that has flown into the ink absorbent 114 is exhausted outside by the second fan 105 installed in the second duct 104 of the ink absorbent case 113 and driven by a motor (not shown) after having passed inside the ink absorbent 114.

The structure and operation of the ink jet recording apparatus 100 of the present embodiment are fundamentally the same as those of the ink jet recording apparatus 40 described in the second embodiment with the exception of what has been described so far. Therefore, further detailed description thereof will be omitted.

In this respect, for the present embodiment, description has been made of one example in which the bars 111 are used for regulating the positions of the recording medium 112. However, the positional regulation is not necessarily limited to the provision of the bars. For example, it may be possible to use a plate member provided with linear extrusions or an embossed plate member.

Also, the structure of the present embodiment may be applicable to any one of the ink jet recording apparatuses described in the first embodiment to the fifth embodiment, and the seventh embodiment which will be described later.

As described above, the air within the cover 101 flows into the ink absorbent case 113 through the ink receiving port 109 after having flown around the recording head 115. As a result, the ink mist of the ink that has been discharged from the recording head 115 of the ink jet recording head cartridge 110, which is allowed to float in the air, is compulsorily exhausted into the ink absorbent case 113. Thus, there is no possibility that the recording medium 112 is stained with ink mist.

As has been described above, it is possible for the ink jet recording apparatus 100 of the present embodiment to record without forming any marginal portions on the left and right edges of each recording medium as in the case of the ink jet recording apparatuses of the first to fifth embodiments.

(Seventh Embodiment)

Figure 14:
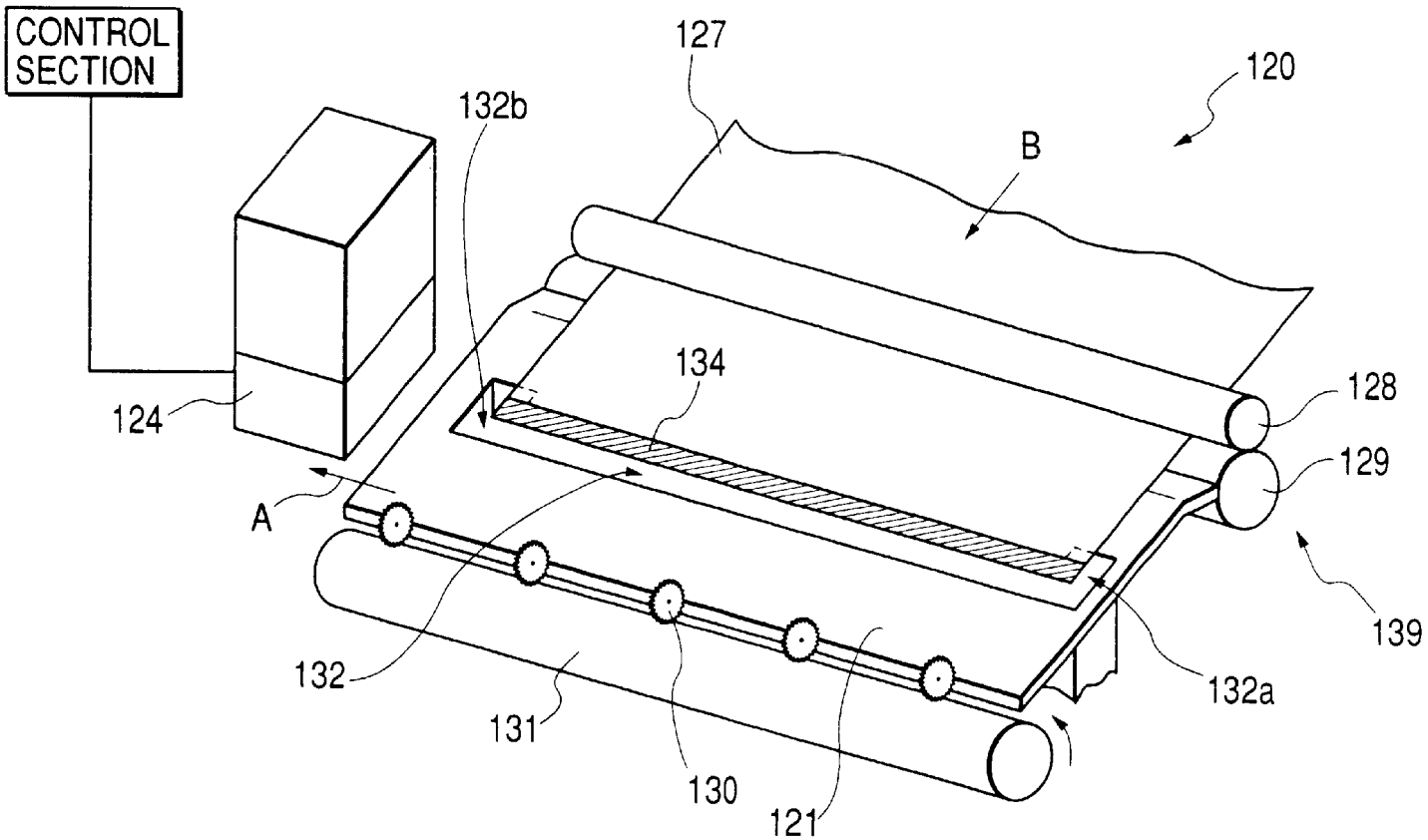
FIG. 14 is a perspective view which schematically shows the structure of the recording unit of an ink jet recording apparatus in accordance with a seventh embodiment of the present invention.

FIG. 14 is a perspective view which schematically shows the structure of a recording unit 139 of an ink jet recording apparatus 120 in accordance with a seventh embodiment of the present invention. Also, FIG. 15 and FIG. 16 are cross-sectional views which schematically illustrate the state where recording is effected respectively on the front end portion 137 and on the rear end portion 138 of the recording medium 127 by use of the recording unit 139 of the ink jet recording apparatus 120 shown in FIG. 14.

In accordance with the present embodiment, the platen plate 121 of the ink jet recording apparatus 120 is provided with a first movable platen plate 122 capable of being opened and closed, and a second movable plate 123. Also, for the platen plate 121, a front side ink receiving port 132 is formed to connect ink receiving port 132*a* and ink receiving port 132*b* corresponding to the left and right edges of recording medium 127. Also, a rear side ink receiving port 133 is formed to connect the ink receiving port 132*a* and the ink receiving port 132*b* corresponding to the left and right edges of the recording medium 127.

Now, description will be made of a method for recording borders 134 on the recording medium 127 by use of the ink jet recording apparatus 120 of the present embodiment.

Figure 15:
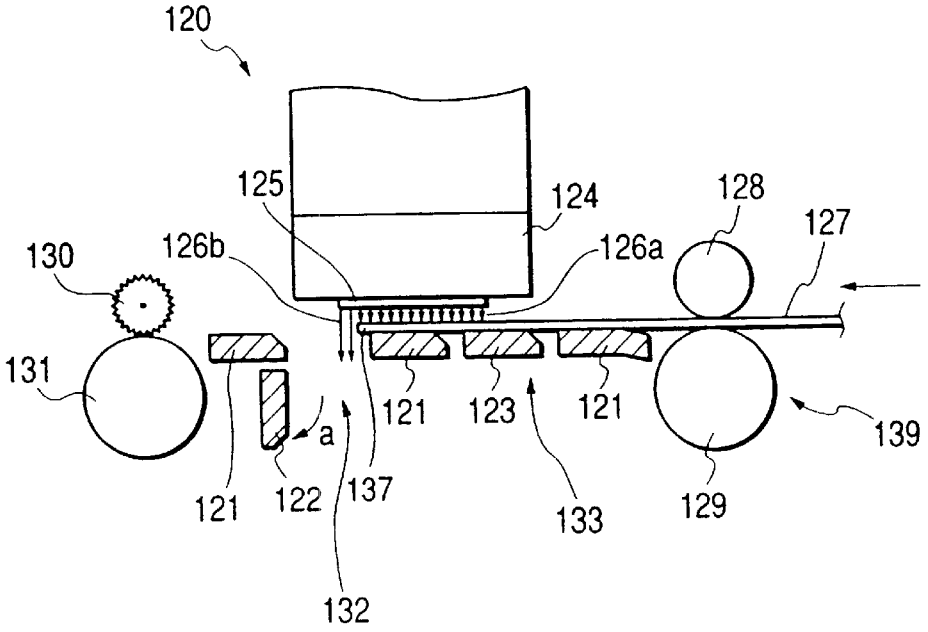
FIG. 15 is a cross-sectional view which schematically illustrates the state where recording is effected on the front end portion of a recording medium by the ink jet recording apparatus shown in FIG. 14.
Figure 16:
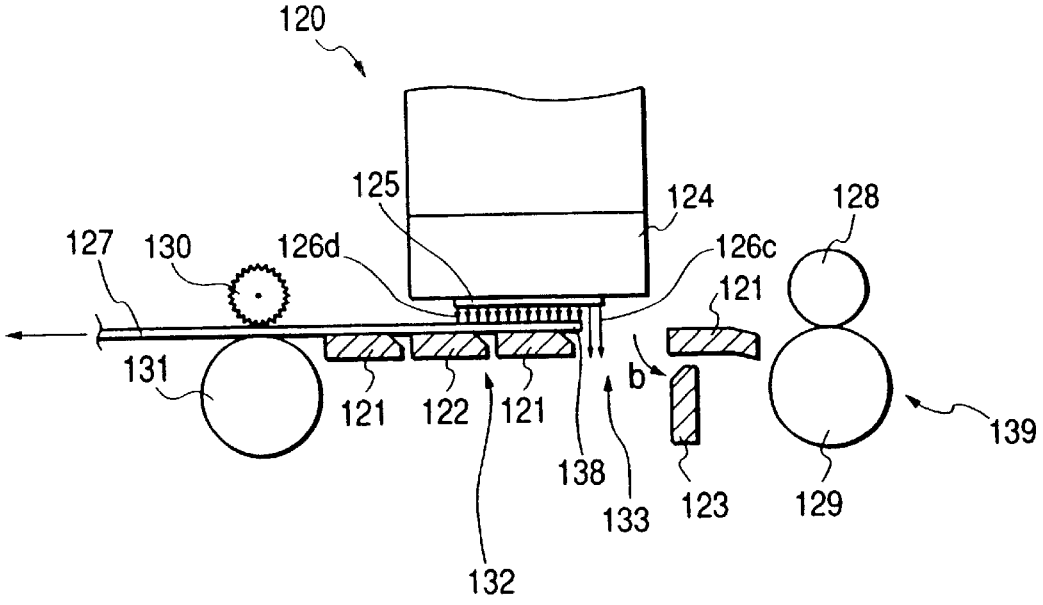
FIG. 16 is a cross-sectional view which schematically illustrates the state where recording is made on the rear end portion of the recording medium by the ink jet recording apparatus shown in FIG. 14.
Figure 17:
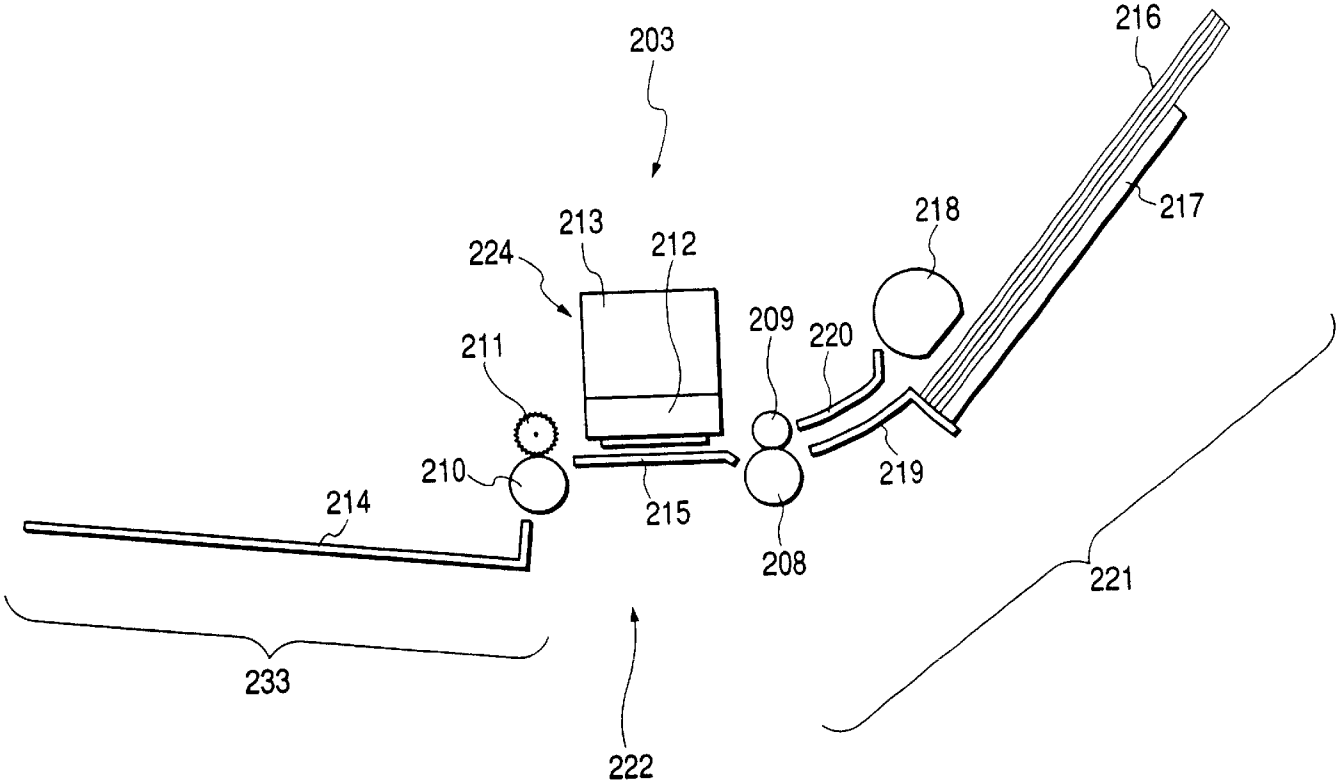
FIG. 17 (PRIOR ART)
FIG. 17 is a side view which schematically illustrates the principal structure of the conventional ink jet recording apparatus.
Figure 18:
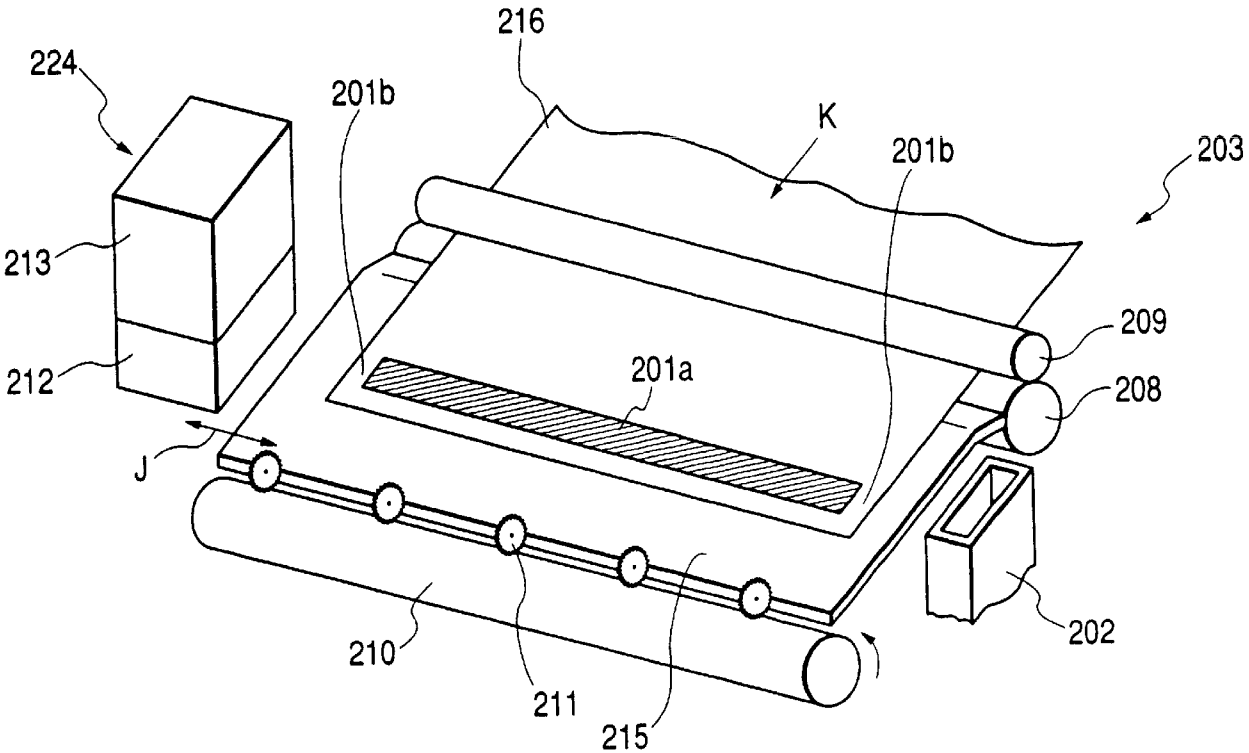
FIG. 18 (PRIOR ART)
FIG. 18 is a perspective view which schematically shows the conventioal ink jet recording apparatus.

As shown in FIG. 15, the recording medium 127 is nipped by first sub-scanning rollers 127 and 128 and carried to a position below nozzle array 125 of recording head 124. Then, the first movable platen plate 122 is retracted in the direction indicated by an arrow a so that the front side ink receiving port 132 is in the open state. In this state, ink droplets 126*a* and ink 126*b* are discharged from the nozzle array 125. Ink droplets 126*b* thus discharged are mainly directed toward the front side ink receiving port 132, and ink droplets 126*a* thus discharged thus discharged are directed to the front edge portion 137 of the recording medium 127 to form the border 134.

Then, as the recording medium 127 is carried while being nipped by second sub-scanning rollers 130 and 131, the trailing end 138 of the recording medium 127 passes under the nozzle array 125 of the recording head 124. At this juncture, the second movable platen plate 123 is retracted in the direction indicated by an arrow b so that the rear side ink receiving port 133 is in the open state. In this state, ink droplets 126*c* and ink droplets 126*d* are discharged from the nozzle array 125. Ink droplets 126*c* thus discharged are mainly directed toward the rear side ink receiving port 133, and ink droplets 126*d* thus discharged are directed to the rear edge portion 138 of the recording medium 127 to form the border on the rear edge portion.

In this respect, FIG. 14 is a perspective view which shows the state in which the border 134 is formed on the front edge portion 137 of the recording medium 127, and shows the state of the front side ink receiving port 132 being open with the retraction of the first movable platen plate 122. Here, the second movable platen plate 123 is in the closed state to cover the rear side ink receiving port 133.

The structure and operation of the ink jet recording apparatus 120 of the present embodiment are fundamentally the same as those of the ink jet recording apparatus 1 described in the first embodiment with the exception of what has been described so far. Therefore, further detailed description thereof will be omitted.

In this respect, for the present embodiment, description has been made of one example in which a flat plate type is used for the platen plate 121. However, the platen plate is not necessarily limited to the flat type. It may be possible to use a plate member which is configured not to be in contact with each recording medium. For example, a plate member provided with linear extrusions or an embossed plate member may be adoptable.

Also, the structure of the present embodiment may be applicable to the line-head type ink jet recording apparatus described in the fifth embodiment.

Further, the structure may be arranged so that the widths of the front side ink receiving port 132, the first movable platen plate 122, the rear side ink receiving port 133, and the second movable platen plate 123 can be made wider in the main scanning direction than the maximum width of a recording medium to be used for recording, hence being able to accommodate each recording medium of different widths.

With the structure arranged as described above, not only it is possible for the ink jet recording apparatus 120 of the present embodiment to record without forming any marginal portions on the front edge 137 and the rear edge 138, but also, to record without forming any marginal portions on the left and right edges of each recording medium as in the case of the ink jet recording apparatuses of the first to sixth embodiments.

Now, hereunder description will be made of the above embodiment with specific dimensions.

For the present embodiment, the border 13 is recorded on the recording medium 9 by use of the ink jet recording apparatus 1 described in the first embodiment.

The distance $L_2$ between the outer end portion 11*c* corresponding to the outer edge of the ink receiving port 11*a*, and the outer end portion 11*d* corresponding to the outer edge of the ink receiving port 11*b* is 230 mm. The range $L_3$ of ink discharge is 220 mm. Also, the recording medium 9 is an A4-sized sheet (297 mm×210 mm). The recording medium 9 is carried in the longitudinal direction for recording. Therefore, the width $L_1$ of the recording medium 9, which is from the right edge 9*a* to the left edge 9*b*, is 210 mm.

In the case of the above structure, ink is discharged in a range which is wider than the distance across both edges of the recording medium by 5 mm. Therefore, it becomes possible to cover the edges of the recording medium 9 with ink sufficiently even if the feeding position of the recording medium is deviated by a range of approximately 1 to 3 mm. Also, the ink discharge terminates within a range which is narrower than the distance across the outer end portion 11*c* of the ink receiving port 11*a* and the outer end portion 11*d* of the ink receiving port 11*b* by 5 mm, hence making it possible to collect the ink which is discharged but does not arrive at the recording medium 9 without staining the platen plate 10.

As has been described, the ink jet recording apparatus of the present embodiment comprises carrying means for carrying a recording medium; the head installation unit which mounts thereon the recording head for recording on the recording medium by discharging ink from the discharge ports thereof, and which reciprocates in the width direction of the recording medium, which is orthogonal to the carrying direction thereof; and supporting means for supporting the recording medium at a position that faces the recording head. Then, the opening is arranged on each end portion of the recording medium in the width direction in order to collect ink discharged from the recording head, thus making it possible to record up to the edges of the recording medium in high quality.

What is claimed is:

1. An inkjet recording apparatus comprising:

carrying means for carrying a recording medium;

a recording head for discharging ink to record on the recording medium;

a head mounting portion for mounting said recording head;

a support member for supporting the recording medium at a position opposed to said recording head; and means for providing a plurality of openings for collecting ink discharged from said recording head to an end of the recording medium in a widthwise direction of the recording medium, at least one of the openings being movable in the widthwise direction.

2. An ink jet recording apparatus according to claim 1, further comprising a positioning member for positioning the recording medium in the widthwise direction, wherein the movable opening moves in association with movement of said positioning member.

3. An ink jet recording apparatus according to claim 1, further comprising air flow generating means for generating an air flow from said recording head to the openings.

4. An ink jet recording apparatus according to claim 3, further comprising moisture means for adding moisture to the air flow.

5. An ink jet recording apparatus according to claim 1, wherein said head mounting portion is a carriage reciprocally movable in the widthwise direction of the recording medium with said recording head mounted.

6. An ink jet recording apparatus according to claim 1, wherein said recording head is a line head in which a nozzle array is formed in a range over a width of the recording medium.

7. An ink jet recording apparatus according to claim 1, wherein said recording head is provided with electrothermal transducer elements for generating thermal energy for use of ink discharge.

8. An ink jet recording apparatus according to claim 7, wherein ink is discharged from discharge ports by utilization of film boiling created by thermal energy from said electrothermal transducer elements.

9. An inkjet recording apparatus comprising:

carrying means for carrying a recording medium;

a recording head for discharging ink to record on the recording medium;

a head mounting portion for mounting said recording head;

a support member for supporting the recording medium at a position opposed to said recording head;

means for providing a plurality of openings provided on said support member to collect ink discharged from said recording head, the openings being juxtaposed in a conveying direction of the recording medium; and a cover member movable for opening/closing the plurality of openings.

10. An ink jet recording apparatus according to claim 9, wherein said head mounting portion is a carriage reciprocally movable in the widthwise direction of the recording medium with said recording head mounted.

11. An ink jet recording apparatus according to claim 9, wherein said recording head is a line head in which a nozzle array is formed in a range over a width of the recording medium.

12. An ink jet recording apparatus according to claim 9, wherein said recording head is provided with electrothermal transducer elements for generating thermal energy to discharge ink.

13. An ink jet recording apparatus according to claim 12, wherein ink is discharged from discharge ports by utilization of film boiling by thermal energy from said electrothermal transducer elements.

* * * * *

UNITED STATES PATENT AND TRADEMARK OFFICE

CERTIFICATE OF CORRECTION

PATENT NO. : 6,457,803 B1
DATED : October 1, 2002
INVENTOR(S) : Ohkoda

It is certified that error appears in the above-identified patent and that said Letters Patent is hereby corrected as shown below:

Title page,
Item [56], References Cited, FOREIGN PATENT DOCUMENTS,
"0 95 603 4/2000" should read -- 0 995 603 4/2000 --.

Column 6,
Line 35, "is" should be deleted.

Column 13,
Line 38, "thus discharged" (second occurrence) should be deleted.

Signed and Sealed this

Twentieth Day of May, 2003

JAMES E. ROGAN
*Director of the United States Patent and Trademark Office*